US009368915B2

(12) United States Patent
Mueller et al.

(10) Patent No.: US 9,368,915 B2
(45) Date of Patent: Jun. 14, 2016

(54) CONTACT SET FOR A CONNECTION SOCKET

(71) Applicant: MCQ TECH GmbH, Blumberg (DE)

(72) Inventors: Hartmut Mueller, Braeunlingen (DE); Florian Padditz, Engen (DE)

(73) Assignee: MCQ TECH GmbH, Blumberg (DE)

( * ) Notice: Subject to any disclaimer, the term of this patent is extended or adjusted under 35 U.S.C. 154(b) by 0 days.

(21) Appl. No.: 14/330,413

(22) Filed: Jul. 14, 2014

(65) Prior Publication Data

US 2015/0072563 A1 Mar. 12, 2015

(30) Foreign Application Priority Data

Jul. 30, 2013 (DE) ..... 10 2013 108 130

(51) Int. Cl.
*H01R 13/6466* (2011.01)
*H01R 24/64* (2011.01)
*H01R 13/66* (2006.01)

(52) U.S. Cl.
CPC ..... *H01R 13/6466* (2013.01); *H01R 24/64* (2013.01); *H01R 13/6658* (2013.01)

(58) Field of Classification Search
USPC ..... 439/620.22, 620.17, 676, 76.1, 941
See application file for complete search history.

(56) References Cited

U.S. PATENT DOCUMENTS 5,647,767 A * 7/1997 Scheer et al. ..... 439/620.17
6,155,881 A 12/2000 Arnett et al.
7,357,683 B2 * 4/2008 Caveney et al. ..... 439/894
7,708,603 B1 * 5/2010 Little ..... 439/676
7,850,492 B1 * 12/2010 Straka et al. ..... 439/676
8,016,621 B2 9/2011 Bopp et al.
8,128,433 B2 * 3/2012 Schempp et al. ..... 439/620.22
2007/0254529 A1 * 11/2007 Pepe et al. ..... 439/676
2009/0258545 A1 10/2009 Pepe et al.
2009/0269978 A1 10/2009 Pepe et al.
2010/0151707 A1 6/2010 AbuGhazaleh et al.

FOREIGN PATENT DOCUMENTS

DE 699 06 240 T2 12/1999
EP 1 858 118 A1 5/2007

OTHER PUBLICATIONS

Office action of German patent and trade office, issued Mar. 20, 2014 (untranslated).
European Patent Office Search Report, issued Dec. 9, 2014 for parallel European application 14 176103.1 (untranslated).

* cited by examiner

*Primary Examiner* — Alexander Gilman
(74) *Attorney, Agent, or Firm* — Juneau & Mitchell

(57) ABSTRACT

The invention relates to a contact set for a connection socket, with the contact set comprising at least two contact elements, with the contact elements comprising at least a first section, a second section, and a third section, with the first section comprising a connection element, with the contact elements being fixed in their respective position towards each other by an isolation body in the second section, and with the third section comprising a contact area for a contact element of a plug to be inserted into the connection socket, with the contact elements comprising a fourth section for contacting a compensation element that can be arranged between the fourth section and the isolation body.

20 Claims, 4 Drawing Sheets

CONTACT SET FOR A CONNECTION SOCKET

CROSS REFERENCE TO RELATED APPLICATIONS

This patent application claims priority German Patent Application 10 2013 108 130.4, filed on Jul. 30, 2013.

STATEMENT REGARDING FEDERALLY SPONSORED RESEARCH OR DEVELOPMENT

No federal government funds were used in researching or developing this invention.

NAMES OF PARTIES TO A JOINT RESEARCH AGREEMENT

Not applicable.

SEQUENCE LISTING INCLUDED AND INCORPORATED BY REFERENCE HEREIN

Not applicable.

BACKGROUND

1. Field of the Invention

The present invention relates to a contact set for connection socket

2. Background of the Invention

The current state of knowledge is as follows.

Contact sets for connection sockets, particularly for RJ45-sockets, are known for various transmission capacities. In order to describe the capacity of electronic components they are classified in categories. Presently common categories are Cat-5, which is defined for operating frequencies up to 100 MHz, Cat-6, which is defined for operating frequencies up to 250 MHZ, or Cat-6A, which is designed for transmission frequencies up to 500 MHz and distances up to 100 m. It is quite possible that in the future electronic components will become common with even better transmission features.

In order for cables or sockets to yield transmission features according to a certain category, it is demanded that the near end cross talk (NEXT for short) is suppressed to a certain extent. For this purpose it is known to provide compensation circuits which reduce or suppress said near end cross talk.

In order to yield the transmission features of category 6a for a connection socket it has shown that it is beneficial to place a compensation of the near end cross talk as closely as possible near the contact site between the socket and a plug inserted into said socket.

For this purpose, EP 1 306 934 B1 provides a socket fastened on a motherboard, with a compensation circuit board being arranged within the accepting element of a socket, which includes a compensation circuit for reducing disturbing interferences, particularly near end cross talk, and with contact elements being fastened thereat, connected to an inserted plug, with the motherboard comprising an additional compensation circuit to prevent disturbing interferences.

In order to place a compensation circuit even closer to the contact site between the plug and the socket, EP 1 858 118 A1 discloses a socket with a contact set, which comprises several contact elements, with at the free ends of the contact elements, which project into the interior of the socket in which the plug is inserted, a compensation circuit is arranged, for example in the form of a flexible substrate with a compensation circuit.

WO 0180376 A1 discloses a compensation circuit board arranged in the housing of the socket, elastically contacted by the free ends of the contact elements, which are fastened with their other end at a circuit board.

For many applications a connection socket is desired, showing optimal transmission features and thus fulfilling the features of a category as high as possible. However, with rising transmission capacities in general the production costs of the sockets increase so that sockets of a lower category are sufficient for certain applications.

Accordingly, many discussions have been conducted in order to embody a connection socket such that the transmission features of the socket can easily be alternated between two categories.

U.S. Pat. No. 6,074,256 shows a connection socket with a contact set comprising several contact elements, with a compensation circuit board being arranged fixed in said connection socket and, optionally the contact elements do or do not contact the compensation circuit board, so that, depending on the selection, here the compensation circuit board with the compensation can be connected or disconnected, in order to switch between different transmission capacities.

U.S. Pat. No. 6,056,568 discloses a compensation circuit board arranged in a displaceable fashion in the housing of the connection socket, with the compensation being connected or disconnected depending on the positioning of the compensation circuit board. In the solutions according to U.S. Pat. No. 6,074,256 and U.S. Pat. No. 6,056,568 it is disadvantageous that in every socket all components for the desired higher category need to be already provided, which leads to high production costs.

U.S. Pat. No. 6,102,722, which is the starting point of the present invention, discloses a connection socket that can be retrofitted, in which a compensation circuit board can be inserted between the contact elements of the contact set and a part of the housing wall. When the compensation circuit board is inserted, additional measures need to be taken so that the compensation circuit board cannot fall out of the socket.

The objective of the invention therefore comprises to provide a contact set for a connection socket, which can be produced with low manufacturing costs and in which retrofitting from one transmission capacity to another transmission capacity can occur in a simple fashion.

BRIEF SUMMARY OF THE INVENTION

In a preferred embodiment, a contact set for a connection socket, with the contact set comprising at least two contact elements, with the contact elements comprising at least a first section, a second section, and a third section, with the first section showing a connection element, with the contact elements being fixed in their relative position to each other by an isolation body in the second section, and with the third section showing a contact area for a contact element of a plug to be inserted into a connection socket, characterized in that that contact elements show a fourth section for contacting a compensation element that can be arranged between the fourth section and the isolation body.

In another preferred embodiment, the contact set as described herein, wherein the fourth sections of the contact elements are embodied for a clamping fixation of the compensation element that can be arranged between the fourth section and the isolation body.

In another preferred embodiment, the contact set as described herein, wherein the fourth sections of the contact elements are embodied such that contacting of the isolation body occurs via the fourth section by way of inserting the compensation element between the fourth section and the isolation body.

In another preferred embodiment, the contact set as described herein, wherein the fourth sections of the contact elements are embodied such that upon inserting the compensation element between the fourth section and the isolation body a distance is given between the fourth section and the compensation element and the contacting of the compensation element occurs via the fourth section upon inserting a plug into the connection socket.

In another preferred embodiment, the contact set as described herein, wherein the contact set with a contacted compensation element is suitable for operating frequencies up to 500 MHz, particularly fulfilling the specifications of Cat-6A, and the contact set without the contacted compensation element is suitable for operating frequencies up to 250 MHz, particularly fulfilling the specifications of Cat-6.

In another preferred embodiment, the contact set as described herein, wherein the isolation body and the third section of the contact elements form an acute angle, with it being possible to insert the compensation element into said acute angle.

In another preferred embodiment, the contact set as described herein, wherein the fourth section is arranged between the second section and the third section.

In another preferred embodiment, the contact set as described herein, wherein the compensation element shows contact areas for contacting the fourth sections.

In another preferred embodiment, the contact set as described herein, wherein the compensation element comprises condensers, which are connected to the contact areas in an electrically conductive fashion.

In another preferred embodiment, the contact set as described herein, wherein the compensation element is embodied as a circuit board.

In another preferred embodiment, the contact set as described herein, wherein the contact set comprises a first section, in which at least two of the contact elements are arranged intersecting each other.

In another preferred embodiment, the contact set as described herein, wherein the contact set comprises a second section, in which the contact elements are guided parallel in reference to each other and at least two of the contact elements show a different distance from each other than in the first section or in the third section.

In another preferred embodiment, the contact set as described herein, wherein the isolation body comprises at least one insert element for inserting into a socket housing.

In another preferred embodiment, the contact set as described herein, wherein the isolation body comprises at least one latch element for fixing in a socket housing.

In another preferred embodiment, the contact set as described herein, wherein the isolation body comprises at least one guide element for inserting the compensation element.

In another preferred embodiment, the contact set as described herein, wherein the isolation body comprises at least one positioning element for positioning the compensation element.

In another preferred embodiment, the contact set as described herein, wherein the isolation body is injection molded around the contact elements.

In a more preferred embodiment, a connection socket with a contact set as described herein.

In another preferred embodiment, a connection socket as described herein, wherein the connection socket comprises a socket housing and an accepting opening for accepting a plug of a data cable, with the isolation body and the fourth section of the contact elements of the contact set forming an acute angle, which opens towards the wall of the socket housing opposite the accepting opening.

In a more preferred embodiment, a receptacle or junction box with at least one connection socket with a contact set as described herein.

In another preferred embodiment, a receptacle or junction box with at least one motherboard comprising at least one connection socket showing a contact set according to one of claims 1 to 17, with the motherboard comprising at least one connection element and at least one link for an electrically conductive connection of a contact element of the contact set to the connection element, with it being possible to connect a first cable in the connection socket and a second cable, particularly a stationary laid cable, to the connection element and with the motherboard comprising at least one compensation element.

DETAILED DESCRIPTION OF THE INVENTION

Figure 1:
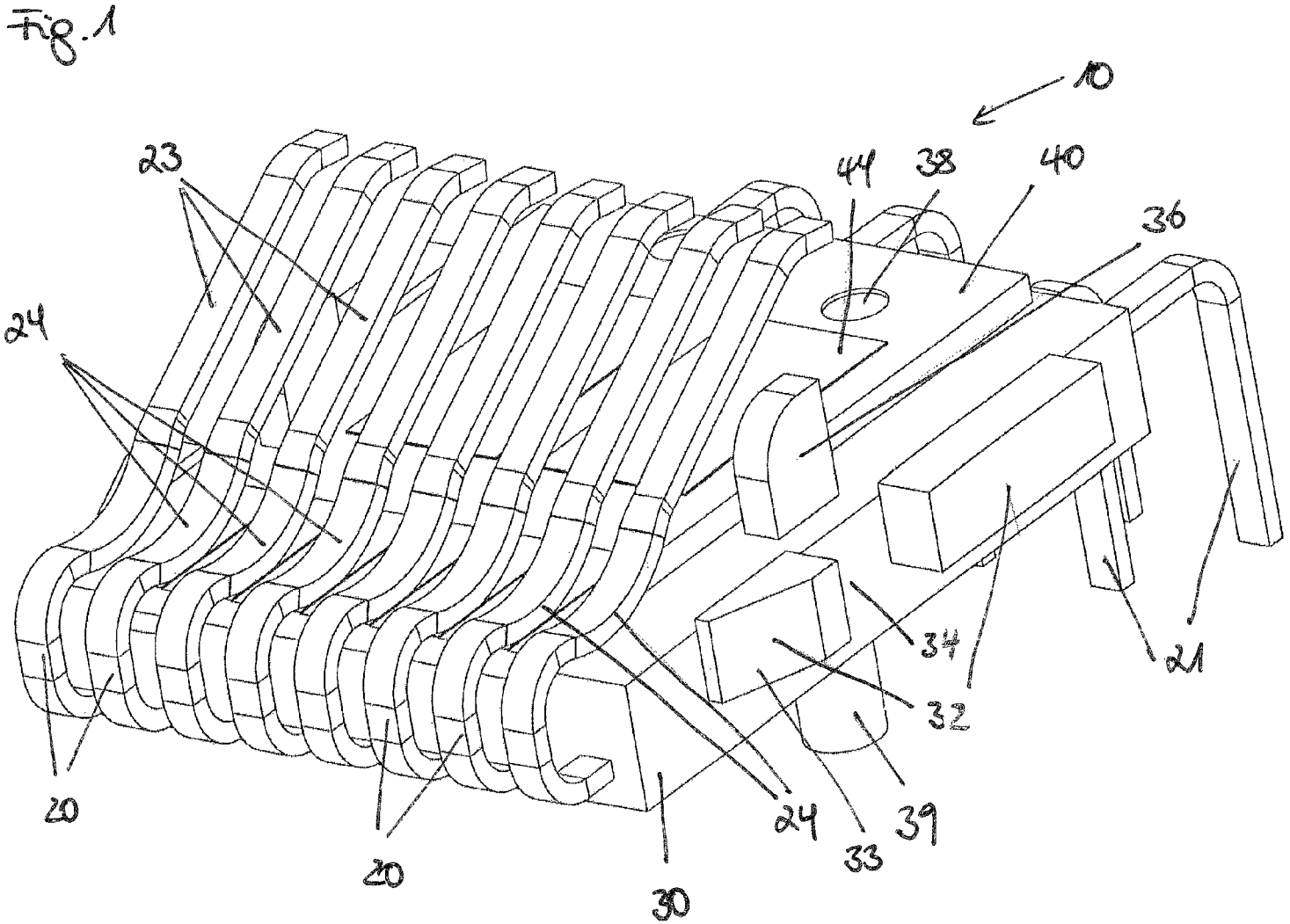
FIG. 1 is a line drawing evidencing a perspective view of a contact set according to an exemplary embodiment of the invention with an inserted compensation element.

The contact set according to the invention for a connection socket, with the contact set comprising at least two contact elements, with the contact elements showing at least a first section, a second section, and a third section, with the first section comprising a connection element, with the contact elements being fixed in their relative position to each other by an isolating body in the second section, and with the third section comprising a contact area for a contact element of a plug to be inserted into the connection socket, is characterized in that the contact elements comprise a fourth section for contacting a compensation element, which can be arranged between the fourth section and the isolation body.

By arranging the compensation element between the contact element and the isolation body, on the one hand the space available in the contact set can be utilized so that the contact set can be designed in a compact fashion. Furthermore, the contact set with the inserted compensation element advantageously forms a unit, which can be inserted into the connection socket and removed from the connection socket. Another advantage of the arrangement of the compensation element between the contact elements and the isolation body is given in that the compensation circuit, compared to a compensation circuit board arranged in a housing outside the contact set, is placed closer to the contact point between the contact elements and a plug inserted in the connection socket, which has advantageous effects for improving the transmission capacity.

According to a preferred embodiment of the invention the fourth sections of the contact elements are embodied for a clamping fixation of the compensation element arranged between the fourth section and the isolation body. This way, the compensation element can already be held in the connection socket by the contact elements, so that no additional measures need to be taken in order to fix the compensation element in the connection socket.

According to an advantageous further development of the invention the fourth sections of the contact elements are embodied such that the contacting of the isolation body occurs by the fourth section when the compensation element is inserted between the fourth section and the isolation body. This way, an electric contacting is already possible by inserting the compensation element, particularly by a simultaneous clamping fixation of the compensation element.

In an alternative embodiment of the invention the fourth sections of the contact elements are embodied such, that when the compensation element is inserted between the fourth section and the isolation body a distance is given between the fourth section and the compensation element and here contacting of the compensation element by the fourth section only occurs upon inserting a plug into the connection socket. An electric contacting therefore only occurs with a simultaneous electric connection of the plug.

By the compensation element being contacted between the contact elements and the isolation body a better transmission capacity can be achieved than without the contacted compensation element, so that only by inserting and contacting the compensation element a switch can occur between different transmission features, particularly between transmission features of different categories. The production costs of connection sockets can be lowered this way, because for the production of connection sockets of a lower category only the contact elements with the isolation body need to be produced and inserted into a respective connection socket, while for a connection socket of a higher category additionally the compensation element is inserted into the otherwise identically designed contact set.

Advantageously the contact set with the contacted compensation element is suitable for operating frequencies up to 500 MHz and fulfills particularly the requirements of category 6A, while the contact set without the contacted compensation element is suitable for operating frequencies up to 250 MHz and particularly fulfills the specifications of category 6. Of course, the compensation element also allows a switch between other categories, which in particular are not required to differ by only one category.

According to a preferred embodiment of the invention the isolation body and the third section of the contact elements form an acute angle, with it being possible to insert the compensation element into said acute angle. This way a particularly compact design is yielded. Advantageously, when the contact set is inserted in the housing of a connection socket here it is pre-vented that the compensation element falls out of the connection socket.

According to a preferred embodiment of the invention the fourth section is arranged between the second section and the third section in order to yield a particularly compact design.

Preferably the compensation element comprises contact areas for contacting the fourth sections, so that particularly in the event that the contacting of the compensation element occurs already upon inserting the compensation element into the contact set, simultaneously with the clamping fixation here the electric contacting and particularly the connection of the compensation circuit is also yielded here.

According to an advantageous embodiment of the invention the compensation element comprises condensers, which are connected to the contact areas in an electrically conductive fashion. This way a simply designed compensation circuit can be yielded on the compensation element.

Advantageously the compensation element is embodied as a circuit board, which allows a simple and cost-effective production.

According to a particularly preferred embodiment of the invention the contact set shows a first section, in which at least two contact elements are arranged intersecting each other. This way, a certain compensation of the near end cross talk is achieved by the arrangement of the contact elements in the contact set, which is particularly advantageous for yielding the trans-mission features of category 6A.

A particularly preferred embodiment of the invention provides that the contact set shows a second section, in which the contact elements are guided parallel in reference to each other and at least two contact elements show a distance from each other, which is different from the one in the first section or in the fourth section. This embodiment leads to a certain compensation of the near end cross talk by this arrangement of the contact elements of the contact set, thus improving the transmission features and particularly allowing to yield the transmission features of category 6a.

Preferably the isolation body comprises at least one insert element for inserting into a socket housing, which facilitates the insertion of the contact set into the socket housing of a connection socket.

Preferably the isolation body comprises at least one latch element for fixation in a socket housing, in order to allow a simple fastening of the contract set in a socket housing.

A preferred embodiment of the invention comprises that the isolation body shows at least one guide element for inserting the compensation element, this way facilitating the insertion of the compensation element between the contact elements and the isolation body of the contact set.

According to a preferred embodiment of the invention the isolation body shows at least one positioning element for positioning the compensation element in order to improve the correct alignment between the compensation element and the contact elements.

Preferably the isolation body is injection molded around the contact elements, which facilitates the production.

A connection socket according to the invention, which shows particularly a housing and an accepting opening to accept a plug of a data cable, with the isolation body and the third section of the contact elements of the contact set forming an acute angle, which opens towards the accepting opening opposite the wall of the housing, shows a contact set according to the invention.

A receptacle according to the invention or a junction box according to the invention comprises at least one connection socket according to the invention with a contact set according to the invention, with the connection socket being fastened in the receptacle or the junction box advantageously being fastened on the motherboard and the motherboard comprising at least one connection element and at least one link for generating an electrically conductive connection of a contact element of the contact set to the connection element, with it being possible to connect a first cable in the connection socket and a second cable, particularly a stationary laid cable, to the connection element and with the motherboard comprising at least one compensation element. Receptacles or junction boxes, which are also called patch fields or patch panels, serve for the generation of a high capacity data connections between lines of a stationary laid cable, for example in the wall of a building, and another particularly flexible data cable and are used for distributing data cables, for example network cables, telephone cables, or fiber-glass cables.

DETAILED DESCRIPTION OF THE FIGURES

FIG. 1 shows a perspective view of an exemplary embodiment of a contact set 10 with several, particularly eight contact elements 20-1, 20-2, 20-3, 20-4, 20-5, 20-6, 20-7, 20-8, in general marked 20, and an isolation body 30, which fixes the contact elements 20 in their relative position to each other. The contact elements 20 are made from electrically conductive material, the isolation body from an isolating material, for example plastic. In particular, the isolation body 30 is injection molded around the contact elements 20.

The contact elements 20 show a first section 21, a second section 22, a third section 23, and a fourth section 24. Here, it shall be pointed out explicitly that the sections 21, 22, 23, 24 are not mandatorily required to abut each other, but that they may also be embodied at least partially or entirely overlapping.

The first section 21 comprises a connection element, which in the present example is particularly embodied as a connection pin.

In the second section 22 the contact elements 20 are surrounded by the isolation body 30 and fixed in their relative position to each other. Here, the first section 21 is bent in reference to the second section 22 of the contact elements 20, particularly by 45° or 90°.

The third sections 23 of the contact elements 20 show a contact area for a contact element of a plug. Here, the third sections 23 are bent in reference to the second sections 22 such that they form an acute angle with the second sections 22 or the surface of the isolation body 30. The third sections 23 are embodied in particular such that under a spring force they can contact the contact elements of the plug.

When the contact elements 20 are arranged in the isolation body 30, particularly the first sections 21 of all contact elements 20 and the third sections 23 of all contact elements 20 are aligned parallel in reference to each other. In particular at least the third sections 23 of the contact elements 209 may be arranged equidistantly.

The isolation body 30 can be embodied essentially as a cubic element. In one embodiment the isolation body 30 comprises at least one insert element 32, which simplifies the insertion and positioning of the contact set 10 in a socket housing 52 of a connection socket 50. Here, the-insert elements 32 are embodied such that they engage guiding grooves 58, which are arranged in the socket housing 52. In a preferred embodiment the insert elements 32 show a bevel 33, which further simplifies the insertion into the socket housing 52, particularly into the guiding grooves 58 of the socket housing 52.

In one embodiment the isolation body 30 comprises at least one, for example two latch elements 34, by which the isolation body 30 latches in the socket housing 52. The latch elements 34 can for example be embodied as undercuts in the insertion elements 32 in order to simplify the production.

At its side facing away from the third sections 23 of the contact elements 20 the isolation body 30 may show one or more positioning elements 39, which serve to align the contact set 10 and/or a connection socket 50 comprising a contact set 10 on a circuit board.

Figure 2:
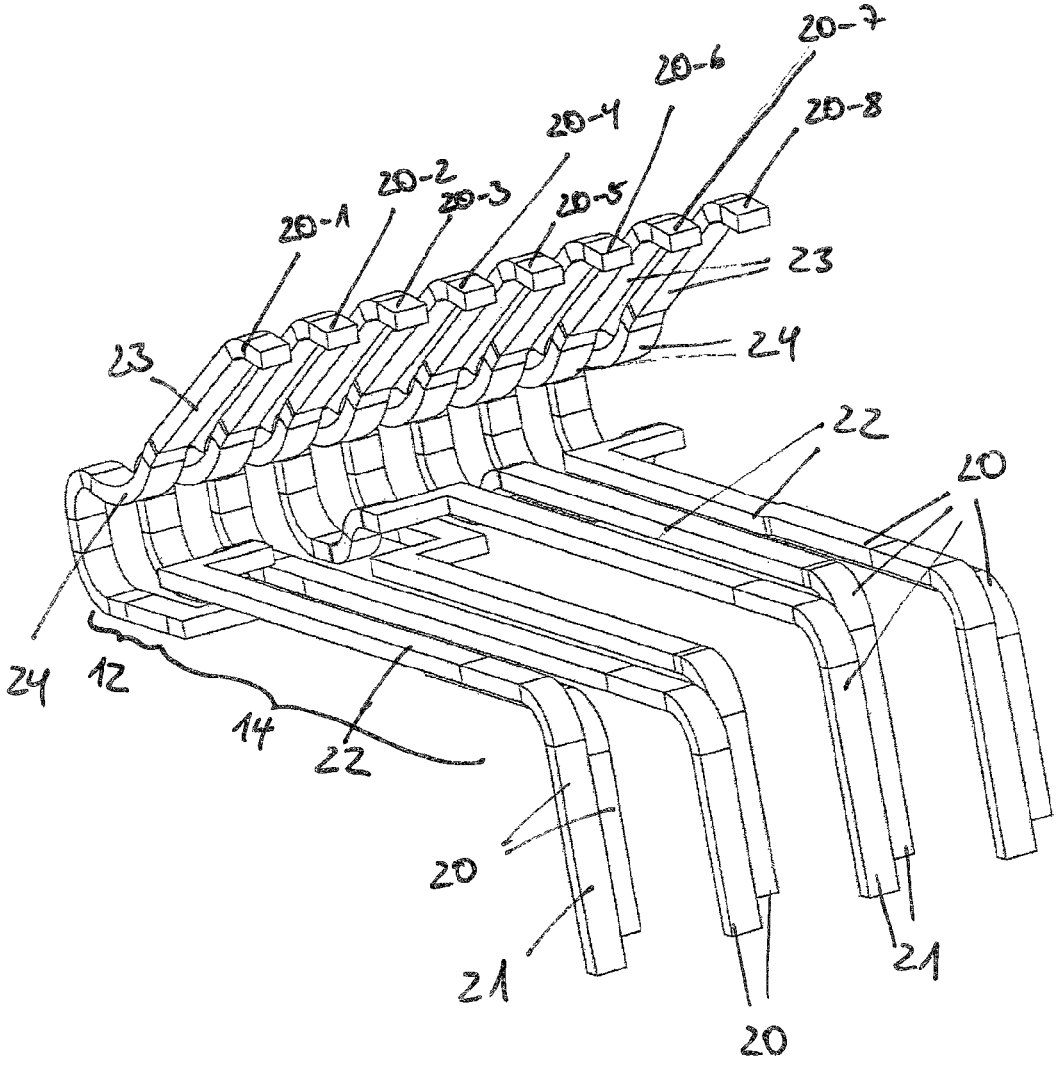
FIG. 2 is a line drawing evidencing the contact elements of the contact set according to FIG. 1.

The contact set 10 with the contact elements 20 and the isolation body 30 shows defined transmission features. They can be influenced and improved in a targeted fashion by a guide shown in FIG. 2 and different contact elements 20 intersecting, particularly in the second sections 22.

In one embodiment at least two of the contact elements 20, for example the contact elements 20-1, 20-2 and/or the contact elements 20-4, 20-5 and/or the contact elements 20-7, 20-8 may be arranged intersecting in a section 12 of the contact set 10. The section 12 is particularly arranged in the isolation body 30 and is particularly located in the second section 22 of the contact elements 20. By intersecting the contact elements 20 a targeted degeneration can be achieved, by which the near end cross talk can be reduced.

Also for the purpose of reducing the near end cross talk in the contact set 10, at least two con-tact elements 20 in a second section 14 of the contact set 10 may show a distance from each other, which is different from the distance, at which the first sections 21 or the third sections 23 are arranged in reference to each other. By such a targeted guidance of the contact elements 20 at a smaller or greater distance from each other here degeneration can be achieved, which reduces the near end cross talk in the contact set 10. The second section 14 particularly follows the first section 12 and particularly contacts the contact elements 20 in the second section 22. In particular the second section 14 is surrounded by the isolation body 30, at least sectionally. The embodiment of the contact set 10 with the guidance of the contact elements 20 in the first section 12 and/or the second section 14 improves the transmission features, however representing an optional embodiment.

In order to allow subsequently influencing the transmission features of an assembled contact set with the contact elements 20 and the isolation body 30 in a targeted fashion a compensation element 40 can be inserted into the acute angle formed between the isolation body 30 and the third sections 23. A fourth section 24 is embodied between the second section 22 and the third section 23 of at least a portion of the contact elements 20, which is suitable for contacting the compensation element 40 arranged between the fourth section 24 and the isolation body 30. For this purpose, the fourth section 24 is embodied arced in the direction towards the isolation body 30.

In one embodiment the compensation element 40 shows contact areas 42, particularly an even number of contact areas 42. It is not mandatory for the number of contact areas 42 to be equivalent to the number of contact elements 20. The contact areas 42 are particularly positioned on the compensation element 40 such that upon contacting the compensation element 40 the fourth sections 24 come to abut the contact areas 42.

In one embodiment of the invention contacting of the compensation element 40 occurs, particularly of the contact areas 42, by the fourth sections 24 directly upon inserting the compensation element 40 into the contact set 20. Here the fourth sections 24 are suitable particularly for a clamping fixation of the compensation element 40 between the fourth sections 24 and the isolation body 30, so that simultaneously with the electric contacting also a mechanic fixation can occur.

In an alternative embodiment of the invention, upon inserting the compensation element 40 into the contact set 20, a distance is formed between the fourth sections 24 and the compensation element 40 and/or the contact areas 42 of the compensation element 40 so that the fourth sections 24 are separated from the compensation element 40. The electric contact only occurs when a plug is inserted into the connection socket and here bends the contact elements 20, particularly the third sections 23 together with the fourth sections 24 in the direction towards the isolation body 20 such that the fourth sections 24 contacting the compensation element 40, particularly the contact areas 42 of the compensation element 40, and here establishing the electric contact and preferably also a mechanic fixation.

The compensation element 40 may show at least one, preferably several condensers, for which here particularly on the surfaces of the compensation element 40 appropriate condenser areas 44 are arranged, which are in an electrically conductive connection to the contact areas 42. This way, a compensation circuit is formed on the compensation element 40, which influences the transmission features of the contact set 10 in a targeted fashion. In particular, the transmission features of the contact set 10 are improved by the inserted compensation element 40.

The transmission features of electronic components are classified in categories, with presently the categories 5, 6, and 6A being particularly common. The compensation element 40 can in-crease for example the transmission features of the contact set 10 by one or more categories. In particular, the contact set 10 is embodied such that it fulfills the transmission specifications of category 6 without any compensation element 40, while fulfilling the transmission specifications of category 6A when the compensation element is inserted.

In one embodiment, in order to facilitate the insertion of the compensation element 40 into the contact set 10, one or more guide elements 36 are arranged of the isolation body 30, particularly at the side of the isolation body 30 facing away from the third sections 23, which advantageously limit the insertion of the compensation element 40 in the lateral direction. In order to position the compensation element 40 at the isolation body 30 one or more positioning elements 38 may be arranged at the isolation body 30, which are embodied as projection for example, engaging respective recesses of the compensation element 40.

Figure 3:
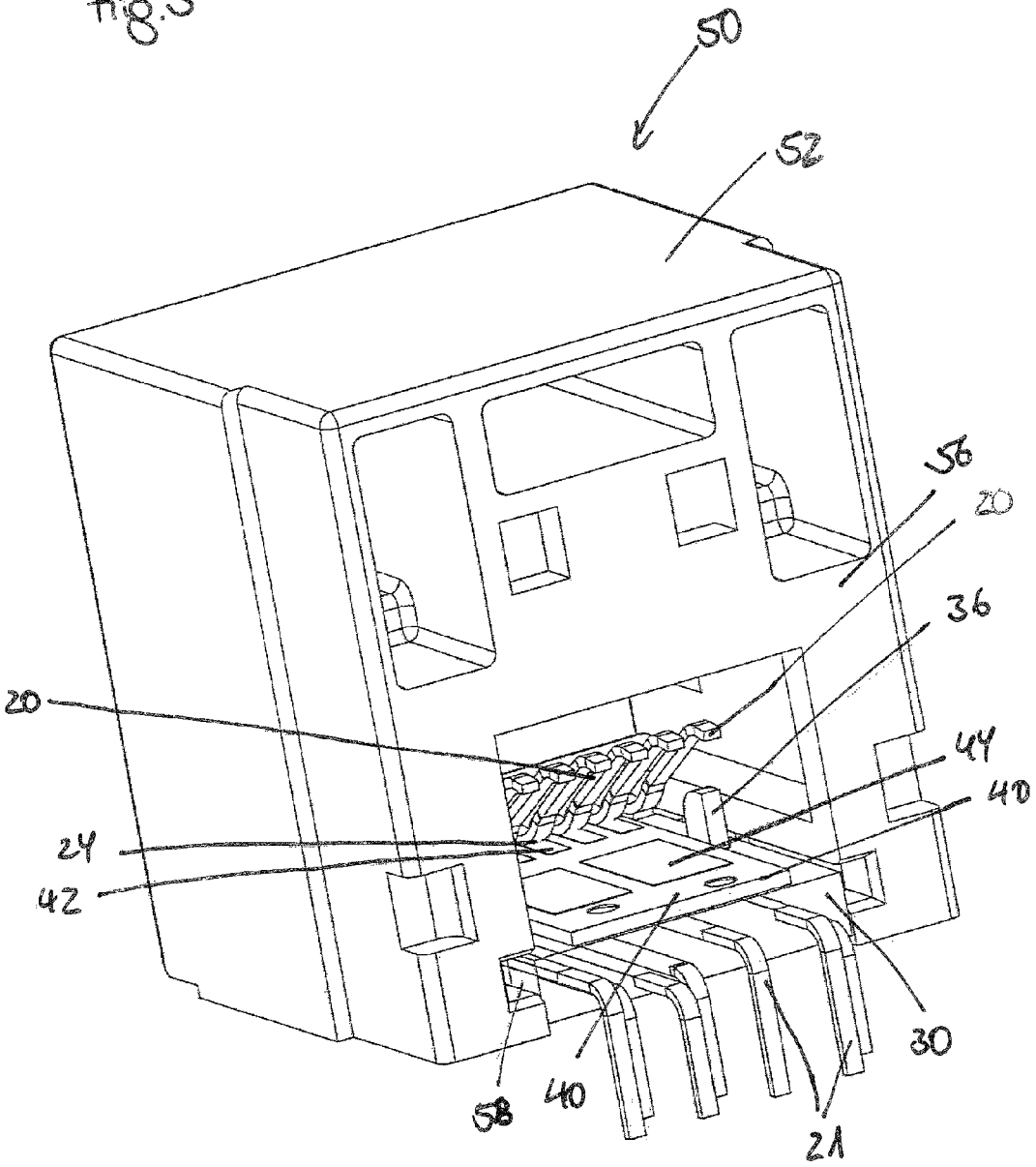
FIG. 3 is a line drawing evidencing a perspective view of a connection socket with a contact set according to FIG. 1.
Figure 4:
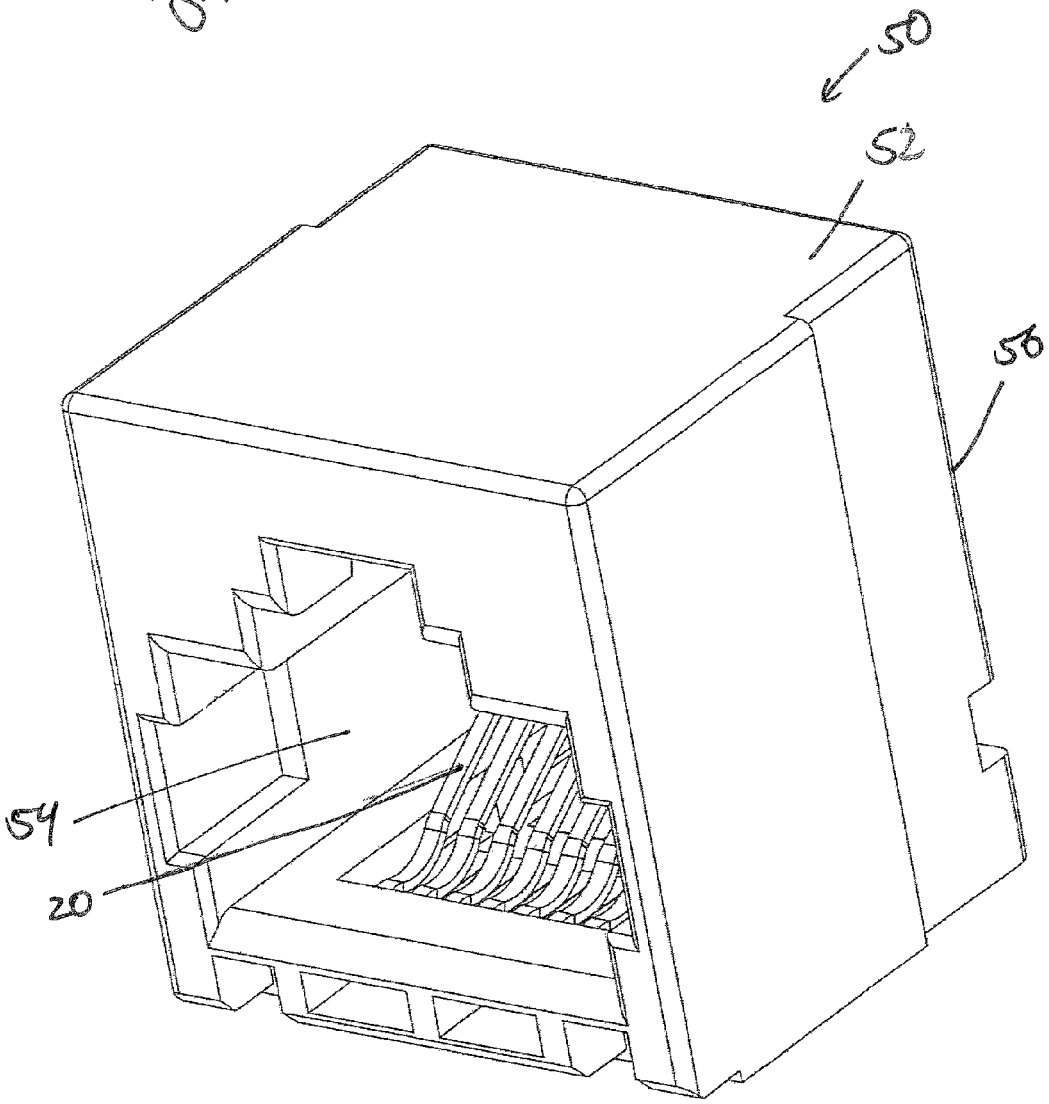
FIG. 4 is a line drawing evidencing another perspective view of the connection socket according to FIG. 3.

FIGS. 3 and 4 show a connection socket 50 with the socket housing 52, in which the contact set 10 according to FIG. 1 is inserted. The connection socket 50 shows an accepting opening 54 at a front, in which a plug of a cable to be connected can be inserted. The plug can particularly be inserted such that contact elements of the plug to be inserted into the connection socket 50 contact the contact elements 20, particularly the third sections 23 of the contact elements 20. The contact set 10 is arranged in the socket housing 52 such that the acute angle formed between the isolation body 30 and the third section 23 opens towards a wall 56, arranged opposite the accepting opening 54. For this purpose, the contact set 10 is inserted from the wall 56 into the socket housing 52, where the contact set 10 latches via the latch elements 34 in the socket housing 52. The arrangement of the compensation element 40 between the isolation body 30 and the third section 23 prevents that the compensation element 40 can fall out of the accepting opening 54. The compensation element 40 can be inserted together with the contact set 10 into the socket housing 52 and be removed therefrom. In the event a connection socket 50 with lower transmission features shall be produced, here only the compensation element 40 is omitted, while the other production steps are kept identical. This way, an easily retrofitted connection socket 50 is yielded, in which the compensation element 40, which can be retrofitted, is arranged as closely as possible near the contact site between the contact elements of the plug and the contact elements 20 of the contact set 10 of the connection socket 50.

Such a connection socket 50 can particularly be used in receptacles or junction boxes, which are also called switch fields or patch fields. Here, one or more connection sockets 50 can be arranged on a motherboard. The motherboard may show at least one connection element and at least one link for generating an electrically conductive connection of the first section 21 of one of the contact elements 20 of the contact set 10 to the connection element, whereas a first cable can be connected in the connection socket 50 and a second cable, particularly a stationary laid cable, to the connection element. The motherboard advantageously comprises at least one compensation element in order to allow an additional compensation of disturbing interferences of the motherboard.

LIST OF REFERENCE NUMBERS

10 Contact set
12 first section
14 second section
20 Contact element
20-1 Contact element
20-2 Contact element
20-3 Contact element
20-4 Contact element
20-5 Contact element
20-6 Contact element
20-7 Contact element
20-8 Contact element
21 first section
22 second section
23 third section
24 fourth section
30 Isolation body
32 Insertion element
33 Bevel
34 Latch element
36 Guide element
38 Positioning element
39 Positioning element
40 Compensation element
42 Contact areas
44 Condenser area
50 Connection socket
52 Socket housing
54 Accepting opening
56 Wall
58 Guide groove The references recited herein are incorporated herein in their entirety, particularly as they relate to teaching the level of ordinary skill in this art and for any disclosure necessary for the commoner understanding of the subject matter of the claimed invention. It will be clear to a person of ordinary skill in the art that the above embodiments may be altered or that insubstantial changes may be made without departing from the scope of the invention. Accordingly, the scope of the invention is determined by the scope of the following claims and their equitable equivalents.

We claim:

1. A contact set for a connection socket, with the contact set comprising at least two contact elements, with the contact elements comprising at least a first section, a second section, and a third section, with the first section showing a connection element, with the contact elements being fixed in their relative position to each other being overmolded by an isolation body in the second section, and with the third section showing a contact area for a contact element of a plug to be inserted into a connection socket, characterized in that that contact elements show a fourth section for contacting a compensation element that can be arranged between the fourth section and the isolation body, such fourth section being arranged between the second section and the third section.

2. The contact set of claim 1, wherein the fourth sections of the contact elements are embodied for a clamping fixation of the compensation element that can be arranged between the fourth section and the isolation body.

3. The contact set of claim 1, wherein the fourth sections of the contact elements are embodied such that contacting of the isolation body occurs via the fourth section by way of inserting the compensation element between the fourth section and the isolation body.

4. The contact set of claim 1, wherein the fourth sections of the contact elements are embodied such that upon inserting the compensation element between the fourth section and the isolation body a distance is given between the fourth section and the compensation element and the contacting of the compensation element occurs via the fourth section upon inserting a plug into the connection socket.

5. The contact set of claim 1, wherein the contact set with a contacted compensation element is suitable for operating frequencies up to 500 MHz, particularly fulfilling the specifications of Cat-6A, and the contact set without the contacted compensation element is suitable for operating frequencies up to 250 MHz, particularly fulfilling the specifications of Cat-6.

6. The contact set of claim 1, wherein the isolation body and the third section of the contact elements form an acute angle, with it being possible to insert the compensation element into said acute angle.

7. The contact set of claim 1, wherein the compensation element shows contact areas for contacting the fourth sections.

8. The contact set of claim 7, wherein the compensation element comprises condensers, which are connected to the contact areas in an electrically conductive fashion.

9. The contact set of claim 1, wherein the compensation element is embodied as a circuit board.

10. The contact set of claim 1, wherein the contact set comprises a first section, in which at least two of the contact elements are arranged intersecting each other.

11. The contact set of claim 1, wherein the contact set comprises a second section, in which the contact elements are guided parallel in reference to each other and at least two of the contact elements show a different distance from each other than in the first section or in the third section.

12. The contact set of claim 1, wherein the isolation body comprises at least one insert element for inserting into a socket housing.

13. The contact set of claim 1, wherein the isolation body comprises at least one latch element for fixing in a socket housing.

14. The contact set of claim 1, wherein the isolation body comprises at least one guide element for inserting the compensation element.

15. The contact set of claim 1, wherein the isolation body comprises at least one positioning element for positioning the compensation element.

16. The contact set of claim 1, where in the isolation body is injection molded around the contact elements.

17. A connection socket comprising the contact set of claim 1.

18. The connection socket of claim 17, wherein the connection socket comprises a socket housing and an accepting opening for accepting a plug of a data cable, with the isolation body and the fourth section of the contact elements of the contact set forming an acute angle, which opens towards the wall of the socket housing opposite the accepting opening.

19. A receptacle or junction box with at least one connection socket comprising the contact set of claim 1.

20. A receptacle or junction box comprising at least one mother board comprising at least one connection socket showing the contact set of claim 1, wherein the motherboard comprises at least one connection element and at least one link for an electrically conductive connection of a contact element of the contact set to the connection element, with it being possible to connect a first cable in the connection socket and a second cable, particularly a stationary laid cable, to the connection element and with the motherboard comprising at least one compensation element.

* * * * *